US005547493A

United States Patent [19]

Krigmont

[11] Patent Number: 5,547,493

[45] Date of Patent: Aug. 20, 1996

[54] ELECTROSTATIC PRECIPITATOR

[76] Inventor: Henry V. Krigmont, 2600 Marigold, Seal Beach, Calif. 90704

[21] Appl. No.: 351,757

[22] Filed: Dec. 8, 1994

[51] Int. Cl.[6] ..... B03C 3/08

[52] U.S. Cl. ..... 96/54; 96/77; 96/79; 96/87

[58] Field of Search ..... 96/70, 54, 86, 96/87, 97, 32, 75–79, 98; 95/79–81

[56] References Cited

U.S. PATENT DOCUMENTS

| | | | |
|---|---|---|---|
| 3,158,454 | 11/1964 | Gustafsson | 96/97 X |
| 3,197,943 | 8/1965 | Ertl et al. | 96/70 |
| 3,892,544 | 7/1975 | Haupt | 96/54 X |
| 4,326,861 | 4/1982 | Matsumoto | 96/32 |
| 5,143,524 | 9/1992 | Inculet et al. | 96/54 X |

FOREIGN PATENT DOCUMENTS

| | | | |
|---|---|---|---|
| 471795 | 2/1929 | Germany | 96/70 |
| 54-158770 | 12/1979 | Japan | 96/97 |

*Primary Examiner*—Richard L. Chiesa
*Attorney, Agent, or Firm*—Howard E. Sandler

[57] ABSTRACT

An electrostatic precipitator, and more particularly an electrostatic precipitator having a sets of improved plate type electrodes having opposing surfaces defining collecting and ionization zones therebetween, and with one of the electrodes in each pair of electrodes including a corona source thereon.

18 Claims, 2 Drawing Sheets

ELECTROSTATIC PRECIPITATOR

FIELD OF THE INVENTION

The present invention relates to an electrostatic precipitator and, more particularly, to a collecting assembly of an electrostatic precipitator for reducing or eliminating the detrimental effects of reverse ionization upon the removal of high-resistance dust and/or aerosols (such dusts and aerosols being hereinafter collectively referred to as "particulate") from a gas stream.

BACKGROUND OF THE INVENTION

A common form of large industrial or utility electrostatic precipitators comprise an array of vertically extending collecting electrodes which are maintained at a relatively positive polarity and an array of discharge electrodes having points (thorns or barbs) or sharp edges constituting corona-discharge regions. Below the base of the collecting electrodes, suitable hoppers or collecting bins are provided, and the collecting electrodes are associated with rapping means for dislodging the collected dust into the bins. The collecting assembly consists of pairs of such dust-collecting electrodes defining a passage for the gas between them, with arrays of corona-discharge electrodes being positioned intermediate pairs of collecting electrodes.

Generally speaking, the corona-discharge electrodes are at negative polarity and are connected to the opposite terminal of the high-voltage direct-current source. The corona-discharge generated between the edges or barbs (i.e. sharp points) of the discharge electrode and the opposite portion of a collecting electrode results in ionization of gases and the generation of charged particles (i.e. negative ions or electrons), which are picked up by the particulate so that the latter become negatively charged. The particulate is then attracted to and collected upon the positively charged collecting electrodes to which they adhere, electrostatically or mechanically, until the collecting electrode is rapped to dislodge the particulate into the hoppers. The particulate laden gas passes generally horizontally between the vertical collecting electrodes.

With the prior art discussed hereinabove, effectiveness of dust collection is reduced in the case of high-resistance particulate, because of the very well known phenomena of reverse ionization at the side of the collecting electrode at which the particulate accumulates. As a result, positively charged particulate may be released or formed by such reverse ionization and such positively charged particles are repelled from and not attracted to the positively-charged collecting surface. As the gas stream passes between the collecting electrodes, therefore, particles which pick up a positive charge by reverse ionization proximal to a collecting electrode tend to move toward the next discharge electrode at which they may pick up a negative charge and then move toward the collecting electrode where they may again pick up a positive charge, and so on. Viewed as a statistical phenomenon, therefore, particles tend to move in a zig-zag fashion between the plane of the discharge electrodes and the collecting electrodes spaced therefrom as the gas entrains such particles along the collecting path. The zig-zag movement is a phenomenon which is associated with high-resistance particulate, and also exists in situations of very low resistivity particulate, such as carbon dusts.

Because of the zig-zag phenomenon, the effectiveness of particulate collection is obviously reduced and hence the performance of an electrostatic precipitator may be substantially lower for high-resistance particles than with normal resistance particulate. One obvious solution to the problem is to increase the conductivity of the dust which is processed. The art has recognized this and in many cases has provided for the introduction of moisture for the humidification of the dust, or for flue gas treatment with sulfur trioxide and/or ammonia, before the gas stream enters the assembly. Naturally, this procedure cannot be used in all cases and depends upon the nature of the gas stream, the nature of the dust and the parameters under which the system operates. However, it is important to improve the efficiency of dust collecting assemblies for high-resistance dusts.

To some extent the hereinabove mentioned deficiencies of prior generally utilized electrostatic precipitators has been recognized, for example as is illustrated in U.S. Pat. No. 4,326,861.

The '861 Patent adopts a differing construction of the corona-discharge electrodes, whereby the surface of the corona-discharge electrode facing away from the side thereof provided with the corona-generating means, (i.e. edges, points, barbs, or thorns), has a large convex surface area to form a collecting surface for reversely polarized dust resulting from reverse ionization. With such a prior arrangement, the discharge electrodes are so oriented and disposed that the discharging and field-forming parts, alternate with one another in the direction of flow of the gas to be treated. In this regard, by forming the field part of each discharge electrode with a convex contour in the direction of the collecting electrode juxtaposed therewith and of a breadth which significantly exceeds the breadth of the corona-generating means, dust particles at the collecting electrode which have been charged to the polarity at which this electrode is maintained by the reverse ionization process described previously, are attracted to the field-forming part of the discharge electrode and are collected thereby.

More specifically, the dust particles near the arresting or collecting electrode, of the '861 Patent, which have been charged to a plus or positive polarity by the positive ions resulting from reverse ionization, are conveniently collected by the field-forming part of the discharge electrode. Meanwhile, the dust particles around the discharge part (i.e. the region of the corona-generating means) which are charged to negative or minus polarity are caught by the collecting electrode. The foregoing requires, naturally, that the collection electrodes be at a relatively more positive polarity than the discharge electrodes.

Consequently, the zig-zag flow of dust particles attributable to reverse ionization is limited and the performance of the dust-arresting assembly of generally accepted prior art can possibly be improved so that the high-resistance dusts with which reverse ionization is a particular problem, are intercepted with high efficiency.

While the arrangement illustrated in the '861 patent appears to be an advance over the prior art theretofore, a number of deficiencies are apparent with the design illustrated therein. More specifically: non-uniform field voltage is apparent because of the breakdown in the gap between adjacent sections of the discharge electrodes; one cannot practically reverse polarity without losing the majority of the collecting area; the design of the discharge electrodes is relatively expensive and does not necessarily present an arrangement for efficient rapping to dislodge accumulated particulate; and others.

SUMMARY OF INVENTION

By means of the present invention, which includes similar configured primarily discharge and collecting electrodes, the deficiencies of the prior art discussed hereinabove are overcome or, in the least, greatly alleviated. The electrodes are plate type, which define alternate primarily ionization or charging zones and collecting zones. The charging zones are defined by relatively larger spaces between adjacently spaced electrodes, as well as a corona discharge means therein. The collecting zones include relatively narrower spacing defined between adjacent electrodes. This differing spacing arrangement may be accomplished in any number of manners (i.e. formed, large pitch corrugations or roll forming, large undulations, and the like) and, for purposes of the description and claims herein, all of such methods, and the resultant configurations, are hereinafter generically referred to as corrugated. Adjacent electrodes are positioned in alternately facing left and right orientations, with the corona discharge means being carried by every other electrode to establish a field in the relatively wider spacing.

As is indicated hereinabove, and will be discussed in detail hereinafter, the novel collecting assembly of the present invention comprises a system of bi-polar charged surfaces which are constructed in such a way that provide alternate separate zones for high tension non-uniform and uniform electrostatic fields. The surfaces of the electrodes are of a design which allows to combine the charging and collecting zones with non-uniform and uniform high tension electric fields, respectively in one common collecting assembly. This arrangement is accomplished through the use of a single modular design, with left and right electrode orientations.

The invention herein alleviates the reverse ionization collection problem in a superior manner than the '861 patent, in a number of ways, including the following: a substantial portion of the discharge plates also offer a collection surface, thereby offering a greater collection surfaces within a given volume; the single modular design is efficient, relatively inexpensive, has less tendency to breakage, and is more adapt to rapping forces; the collecting assembly is significantly better in collecting fines because the electrical field is significantly greater in the narrowed portion; because of the continuity of the plate collection assembly, there is gap between adjacent sections which would result in a limitation on the non-uniform field voltage; reversing polarity is readily accomplished as conditions dictate, without any loss in the collection area (it is to be noted that this ability to readily reverse polarity may substantially alleviate the necessity to rap the electrodes, due to the phenomena of the dust cake on the electrodes repelling when the electrode polarity is changed); an AC power supply can be utilized if desired to create turbulence for mixing and coagulation of high resistivity ash; and the like.

OBJECTS OF THE INVENTION

It is a principal object of the present invention to provide an electrostatic precipitator which incorporates a collecting assembly of the present invention for improved efficiency in the collection of high resistance particulate.

It is another object of the present invention to provide for an improved electrostatic precipitator having more collection surface per cubic foot than was generally available heretofore for similar back pressure parameters.

It is a further object of the present invention to provide an improved electrostatic precipitator for the collection of high resistance particulate, or for very low resistivity particulate, such as with carbon particles, in which the electrodes may have their polarity selectively reversed, without the loss of collection area.

These and other objects and advantages of the present invention will become more readily apparent from the following detailed drawings and description in which:

DESCRIPTION OF THE PREFERRED EMBODIMENT

Figure 1:
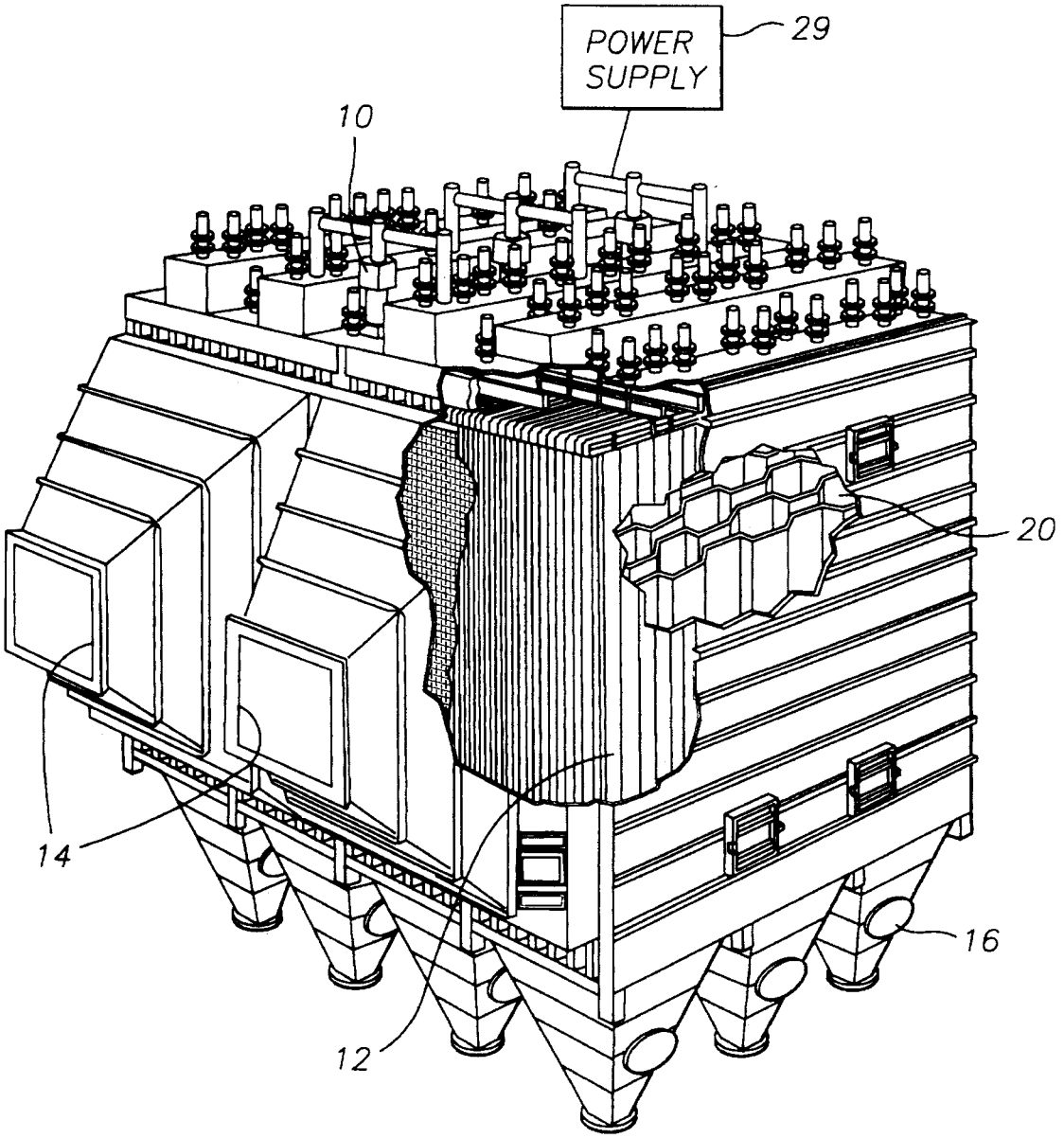
FIG.1 is a schematic illustration of an electrostatic precipitator constructed in accordance with the principles of the present invention by incorporating the improved collecting assembly therein.

FIG. 1 illustrates an electrostatic precipitator 10, which incorporates the dust collecting assembly 12 of the present invention therein. As is known in the precipitator art, generally, particulate laden gas enters the precipitator 10 via an inlet conduit or duct 14, the particulate is separated from the gas stream by electrostatic action and collected by the assembly 12, and is dislodged from the collecting surfaces of the assembly 12 by any suitable means, for example a rapper mechanism (not shown). The dislodged, collected particulate falls into hoppers 16 in a known manner and the cleansed gas then passes from the precipitator 10, via a suitable outlet conduit or duct (not shown). The outlet may direct the gas stream to other pollution abatement mechanisms, or directly to the stack (not shown), for subsequent discharge to the atmosphere.

Dust collecting assembly 12 comprises a plurality of sets 20 of electrodes 22 and 24. Each set 20 is transversely spaced (with respect to the gas flow) from adjacent sets so that electrodes 22 and 24 are spaced from each other. Electrodes 22 and 24 are essentially identical in configuration, with the exception that electrode 24 includes a corona discharge means or source 40 or 41 thereon. A suitable power supply 29 is in communication with the dust collecting assembly 12 to establish a field in a manner known in the art; however, it is to be noted, and will be discussed in further detail hereinafter, that, in addition to the normal DC type power supply, the invention herein readily permits the utilization of an AC power supply, as well as provides the ability to selectively reverse the polarity of the electrodes 22 and 24. This ability to reverse polarity, can result in the cake which has been collected and adheres to the electrodes 22 and 24, becoming oppositely charged and more or less being repelled and peeling from the electrodes, for subsequent collection in the hoppers 16. This repelling may alleviate the necessity for rapping or, in the least, significantly reduce the necessity to rap and, hence, alleviate particulate pollution being discharged into the atmosphere, which sometimes occurs because of rapping losses. Furthermore, because of its continuity and structure of electrodes 22 and 24, the dust collecting assembly 12 is particularly suitable for pulse energization, independently, or in combination with reversing polarity. As is known, pulse energization results in the interruption of the flow of ions, to assist in the prevention, or in the least, the alleviation of back corona. With the structure of collecting assembly 12, very high voltages can be provided to the pulse charge. This will result in a relatively high migration velocity, which in turn translates to high collection efficiency.

Figure 2:
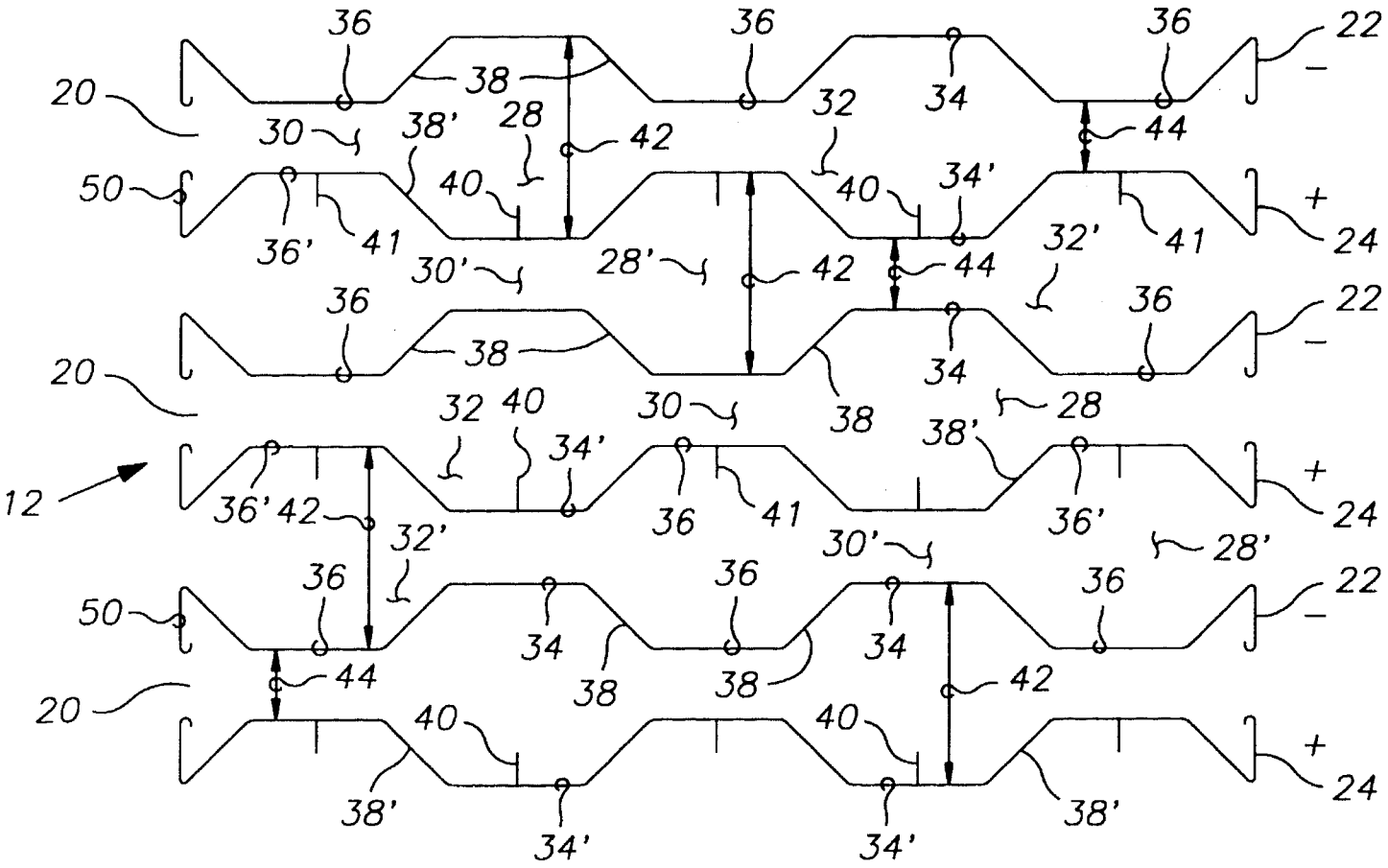
FIG. 2 is plan view illustrating a representative portion of the collecting assembly constructed in accordance with the principles of the present invention.

Referring now to FIG. 2, the sets of electrodes 20 extend in the direction of the gas flow and comprise: a plurality of primarily ionization zones 28; a plurality of collection zones 30 disposed intermediate the ionization zones 28, and transition zones 32 extending between and connecting the ionization and collection zones 28 and 30. The zones 28, 30 and 32 all extend in the direction of-the gas flow and are aligned therealong.

The first electrode 22 is formed in a plate type fashion and includes walls 34, 36 and 38, each of which, in conjunction with the adjacent electrode 24 of each set of electrodes 20, defines one half of the primarily ionization zones 28, the collection zones 30, and transition zones 32, respectively.

In the embodiment illustrated, and other than the corona sources 40 and 41, which will be described hereinafter, the ionization electrode 24 is substantially identical to the first electrode 22; however, each electrode 24 is positioned within a set of electrodes 20, such that electrodes 22 and 24 are in a left and right hand orientation with respect to one another. In view of the similarity of the configuration of electrodes 22 and 24, the wall sections of electrode 24 will be given the same reference numerals primed (i.e. 34', 36' and 38') as the wall sections of electrode 22.

Electrodes 22 and 24 are formed in any suitable manner such that the spacing 42 between walls 34 and 34' (transverse to the gas flow), which defines the primarily ionization zones 28, is greater than similarly oriented transverse spacing 44 between walls 36 and 36', which defines the collection zones 30. Because of the left-right orientation of electrodes 22 and 24, the walls 38 and 38' slope oppositely to connect adjacent sections of walls 34 and 34', with adjacent sections of walls 36 and 36', respectively, to form transition zones 32. To achieve the above described configuration, any suitable technique can be used (i.e. fabrication, formed, large pitch corrugations or roll forming, large undulations and the like), which are referred to in this application collective and individually as "corrugated". The spacing between walls 42 and 44 will vary, depending upon a number of matters (i.e. composition of the anticipated fuel being burned, size of the precipitator 10, the quantity and temperature of flue gas flow, and the like); however, it is anticipated that spacing 42 will be in the range of 6 to 20 inches, and spacing 44 will be in the range of 3 to 12 inches. Furthermore, it is expected that the most preferred areas of operation will call for the spacing 42 being at least 1.5 times spacing 44, and even more specifically, the spacing 42 to 44 will be in the range of 2 to 3 times the spacing 44. For reasons similar to those expressed above, the ratio of the length of primarily ionization zones 28 to the length of the collection zones 30 will, preferably, be in the range of 1 to 1 to 2 to 1.

The dust collecting assembly 12 is comprised of a plurality of aligned (transversely with respect to the direction of gas flow) electrode sets 20. Such sets 20 are arranged in a manner that primarily ionization, collection and transition zones 28, 30' and 32' are formed therebetween such that zones 28' are transversely aligned with zones 30, and zones 30' are transversely aligned with zones 28 of transversely spaced sets of electrodes 20. Zones 28', 30' and 32' are formed by the following walls of adjacent sets 20: 36' and 36 form the collection zones 30'; walls 34' and 34 form the primary ionization zones 28'; and walls 32 and 32' form the transition zones 32'. In the embodiment illustrated, the spacing 42 of the defining walls is equal for the ionization zones 38 and 38', as is the spacing 44 for the collection zones 30 and 30'.

As illustrated a corona source 40 is positioned on each wall 34' and extends toward a wall 34 of the same set of electrodes 20, and a source 41 is positioned on each wall 36' and extends toward wall 36 of adjacent set of electrodes 20. The sources 40 and 41 may be of any suitable configuration which will cause the initiation of an electrical field when power is suitably supplied to the assembly 12 and, as shown, include a plate type configuration which has a sharp edge for establishing the corona. Although only single configured sources are illustrated on the walls described above, it is to be understood that multiple sources can be positioned on such walls and the utilization of corona source herein is to be considered as referring to one or more plates, barbs, and the like on each wall section 34 and 34'.

With a configuration as discussed hereinabove, and assuming a D.C. power supply, the corona sources 40 and 41 will establish a non-uniform electrical field electrical at sections 28 and 28' and a uniform electrical field at sections 30 and 30' to thus charge the particulate to, for example, a positive charge, for collection in sections 30 and 30' by attraction to the oppositely charged walls 36 and 34 of zones 30 and 30', respectively. Furthermore, inasmuch as zones 30 and 30' are parallel and relatively narrower than sections 28 and 28', the uniform field and higher gas velocity through these zones results in superior collection efficiency because of a substantially greater field strength at sections 28 and 28'. Accordingly, collection efficiency of a precipitator 10 utilizing sets of electrodes 20, may be relatively high because migration velocity is nearly proportional to field strength, and higher migration velocity equates to higher collection efficiency. Still further, because the configuration of the present invention yields a multistage charging and collection arrangement, as the gas flows through the assembly 12, additional collection of particulate occurs.

While the configuration described, with a DC source, results in collection occurring primarily on walls 36 of each set 20 and on walls 34 of adjacent sets 20, collection will and does in fact occur to some extent on other areas (i.e. on the oppositely charged transition areas). Furthermore, since a smaller percentage of the particulate will be charged oppositely from the main portion of the particulate, either naturally or because of reverse ionization which occurs during the passage of the gas flow through the precipitator 10, this smaller portion will tend to be collected at walls 36' of each set 20 and at walls 34' of adjacent sets 20.

Because of the continuous nature of the electrodes 22 and 24, selectively reversing of the polarity of the electrodes is possible (i.e. by electrically switching "hot" and grounded outlets of the power supply). Reversing polarity can significantly assist in collection efficiency in certain situations, for example, in instances of high resistivity, the performance of DC powered precipitators usually is degraded; however, an AC powered precipitator is expected to operate at a roughly constant efficiency. Furthermore, the simple fact that polarity is reversed can assist in dislodging and collecting particulate, which has been collected but is caked on the electrodes (i.e. the polarity reversal will result in the caked particulate being urged or pushed away from the electrode due to the repelling force established at the electrode when the polarity is reversed). In addition to reversing polarity, it is possible to provide an A.C. power source either individually, or in combination with a D.C. power source and also to vary the frequency of the power supplied.

Although a particular embodiment of the invention has been described in detail for purposes of illustration, various modifications may be made without departing from the spirit and scope of the invention, for example: more than one corona source 40 and 41, can be positioned within the primary ionization zones 28 and 28', respectively; other configurations of corona sources 40 and 41 are envisioned (i.e. barb, triangular point, and the like); it is anticipated that the electrodes 22 and 24 will be comprised of a number of electrodes of the type indicated in FIG. 2, which are longitudinally aligned at the axial longitudinal ends thereof (i.e. by bolting adjacent sections together at adjacent flanged ends 50, and the like); transitions zones 32 and 32' can be varied; a number of power sources can be used, independently and in combination, including the utilization of a variable frequency; and the like. Accordingly, the invention is not limited, except as by the appended claims.

I claim:

1. An electrostatic precipitator utilizing a high voltage power supply and electrodes for removing particulate matter from a gas stream passing therethrough comprising:

a plurality of spaced pairs of corrugated plate electrodes, each of which extend in the direction of the flow of the gas stream and are spaced from each other transverse to the flow direction;

each of said pairs of electrodes defining a plurality of spaced primarily ionization zones and also defining collecting zones positioned between adjacent primarily ionization zones, the spacing extending in the flow direction; and one electrode of each of said pairs including a corona source thereon in each primarily ionization zone.

2. An electrostatic precipitator as specified in claim 1, wherein the transverse spacing of the portion of said plates in said primarily ionization zones being greater than the transverse spacing of the portion of said plates in said collecting zones.

3. An electrostatic precipitator as specified in claim 2 including transition zones extending between, and connecting, said ionization and collecting zones, and said transition zones including means to prevent the creation of corona discharge therefrom, or at the juncture thereof with said ionization and collecting zones.

4. An electrostatic precipitator as specified in claim 2 wherein the transverse spacing of said plates in said primarily ionization zones is at least 1.5 times the transverse spacing of said plates in said collecting zones.

5. An electrostatic precipitator as is specified in claim 2 wherein the transverse spacing of said plates in said primarily ionization zones is in the range of 2 to 3 times the transverse spacing of said plates in said collecting zones.

6. An electrostatic precipitator as specified in claim 2, wherein the surface area of each of said plates is substantially identical, and the corrugations are aligned and oppositely positioned.

7. An electrostatic precipitator as specified in claim 1 wherein the ratio of the length of said primarily ionization zones to the length of said collection zones is in the range of 1 to 1 and 2 to 1.

8. An electrostatic precipitator as specified in claim 2 wherein said power supply includes opposite terminals connected to transversely alternate plates.

9. An electrostatic precipitator as specified in claim 8 wherein said power supply is a D.C. power supply.

10. An electrostatic precipitator as specified in claim 8 wherein said power supply is an A.C. power supply.

11. An electrostatic precipitator as specified in claim 9 additionally including an A.C. power supply.

12. An electrostatic precipitator as specified in claim 10 additionally including pulse energization means for the selective application of pulses of high energy voltage to said electrodes.

13. An electrostatic precipitator as specified in claim 11 additionally including pulse energization means for the selective application of pulses of high energy voltage to said electrodes.

14. An electrostatic precipitator as specified in claim 8 wherein said power supply is selectively variable.

15. An electrostatic precipitator as specified in claim 9 wherein said power supply includes a positive terminal and said positive terminal is connected to the plate carrying said corona source.

16. An electrostatic precipitator as specified in claim 9 including means to selectively switch the polarity of said plates.

17. An electrostatic precipitator as specified in claim 2 wherein the spacing between adjacent plates is at least 3 inches at said collecting zones, and at least 6 inches at said primarily ionization zones.

18. An electrostatic precipitator as specified in claim 2 wherein the spacing between adjacent plates is in the range of 3 to 12 inches at the collecting zones, and in the range of 6 to 20 inches at the primarily ionization zones.

* * * * *